US008723740B2

(12) United States Patent
Chiu et al.

(10) Patent No.: US 8,723,740 B2
(45) Date of Patent: May 13, 2014

(54) PORTABLE ELECTRONIC DEVICE

(75) Inventors: Chieh-Ping Chiu, Tianwei (TW); Chi-Chang Lin, Taichung (TW)

(73) Assignee: Quanta Computer Inc., Tao Yaun Hsien (TW)

( * ) Notice: Subject to any disclaimer, the term of this patent is extended or adjusted under 35 U.S.C. 154(b) by 219 days.

(21) Appl. No.: 13/471,891

(22) Filed: May 15, 2012

(65) Prior Publication Data

US 2013/0057437 A1 Mar. 7, 2013

(30) Foreign Application Priority Data

Sep. 6, 2011 (TW) ..... 100132099 A

(51) Int. Cl.
*H01Q 1/24* (2006.01)

(52) U.S. Cl.
USPC ..... 343/702

(58) Field of Classification Search
CPC ..... H01Q 9/243; H01Q 9/0421; H01Q 9/42; H01Q 5/0037; H01Q 5/0055
USPC ..... 343/702, 872
See application file for complete search history.

(56) References Cited

U.S. PATENT DOCUMENTS

| | | | | |
|---|---|---|---|---|
| 6,995,718 | B2 * | 2/2006 | Fang | 343/702 |
| 7,777,682 | B2 * | 8/2010 | Yagi | 343/725 |
| 8,618,991 | B2 * | 12/2013 | Jung et al. | 343/702 |
| 2011/0273342 | A1 * | 11/2011 | Park et al. | 343/702 |

* cited by examiner

*Primary Examiner* — Hoang V Nguyen
(74) *Attorney, Agent, or Firm* — Kramer Levin Naftalis & Frankel LLP

(57) ABSTRACT

A portable electronic device includes a housing, a substrate, a radiation conductor and a short circuit conductor. The housing defines an accommodating space and includes a frame that has a body portion and a radiation portion. The substrate is disposed in the accommodating space, is surrounded by the frame, and has a grounding portion. The radiation conductor is disposed in the accommodating space, is electrically coupled to the radiation portion, and includes a feed-in point. The short circuit conductor is electrically coupled between one end of the radiation portion and the grounding portion.

12 Claims, 7 Drawing Sheets

Peak Value = 1.3 dBi, Avg = -1.2 dBi.

Peak Value = 1.5 dBi,Avg = -0.7 dBi.

Peak Value = 0.8 dBi, Avg = -4.9 dBi.

PCS 1850 MHz
Efficiency = -1.9 dB,Gain = 4.7 dBi @ ( 135,180 )

H plane (X-Y plane, θ = 90)

Peak Value = 0.5 dBi, Avg = -3.3 dBi.

E1 plane ( Z-X plane, ϕ = 0 )

Peak Value = 4.7 dBi, Avg = -0.6 dBi.

E2 plane ( Y-Z plane, ϕ = 90 )

Peak Value = 0.3 dBi, Avg = -4.3 dBi.

PCS 1990 MHz
Efficiency = -1.4 dB,Gain = 3.4 dBi @ ( 135,20 )

H plane (X-Y plane, θ = 90)

Peak Value = 1.8 dBi, Avg = -1.4 dBi.

E1 plane ( Z-X plane, ϕ = 0 )

Peak Value = 2.3 dBi, Avg = -2.5 dBi.

E2 plane ( Y-Z plane, ϕ = 90 )

Peak Value = 2 dBi, Avg = -2.3 dBi.

PORTABLE ELECTRONIC DEVICE

CROSS-REFERENCE TO RELATED APPLICATION

This application claims priority of Taiwanese Application No. 100132099, filed on Sep. 6, 2011.

BACKGROUND OF THE INVENTION

1. Field of the Invention

The invention relates to a portable electronic device, more particularly, a portable electronic device with a multiple-frequency antenna.

2. Description of the Related Art

Planar inverted F antennas (PIFA) and loop antennas are two conventional designs of antennas. The resonant length of a PIFA is about one quarter of a wavelength. The resonant length of a loop antenna is about one half of the wavelength. Therefore, the area required to adapt a PIFA is smaller than that for a loop antenna. Since the trend in designing the exterior of most electronic devices nowadays (e.g. mobile phones, tablet computers) tend toward small and thin, it is not easy to fit loop antennas into these small and thin portable electronic devices. On top of that, some exterior designs use metallic materials, causing reductions in efficiency of the built-in PIFA. Loop antennas, on the other hand, are not as easily affected by metals or human body contact. Therefore, the invention looks into how to create a portable electronic device that fits into both exterior design and antenna design specifications.

SUMMARY OF THE INVENTION

Therefore, an object of the present invention is to provide a portable electronic device whose antenna radiation is relatively unaffected by a metallic exterior of the portable electronic device.

The portable electronic device of the present invention includes a housing, a substrate, a radiation conductor and a first short circuit conductor. The housing defines an accommodating space and includes a frame that has a body portion and a radiation portion.

The substrate is disposed in the accommodating space, is surrounded by the frame, and has a grounding portion. The radiation conductor is disposed in the accommodating space, is electrically coupled to the radiation portion, and includes a feed-in point. The first short circuit conductor is electrically coupled to one end of the radiation portion and the grounding portion.

Preferably, the portable electronic device further includes a second short circuit conductor electrically coupled between the other end of the radiation portion and the grounding portion.

Preferably, the radiation portion is a continuous conductor with no breakpoints.

Preferably, the grounding portion has a lateral edge. The radiation conductor includes a radiation section that is disposed spacedly and in parallel to the lateral edge, and a feed-in section that extends from the radiation section towards the lateral edge. One end of the feed-in section that is distal from a junction of the radiation section and the feed-in section and that is proximate to the lateral edge serves as the feed-in point.

Preferably, the radiation conductor further includes a grounding section extending from the junction of the radiation section and the feed-in section and electrically coupled to the grounding portion.

Preferably, the portable electronic device further includes a coupling conductor connected between the radiation section of the radiation conductor and the radiation portion of the frame so that the radiation conductor is electrically coupled to the radiation portion.

Preferably, the radiation portion has a first section and a second section. The first section is parallel to the lateral edge of the grounding portion and is electrically coupled at one end to the second short circuit conductor. The second section is perpendicular to the first section and is electrically coupled between the first short circuit conductor and the other end of the first section.

Preferably, the radiation conductor is a monopole antenna spaced apart from the grounding portion or a planar inverted F antenna.

Preferably, the radiation portion resonates at a first frequency. The radiation conductor resonates at a second frequency.

Preferably, the resonant length of the radiation portion is substantially one half of the wavelength corresponding to the first frequency.

Preferably, the resonant length of the radiation conductor is substantially one quarter of the wavelength corresponding to the second frequency.

BRIEF DESCRIPTION OF THE DRAWINGS

Other features and advantages of the present invention will become apparent in the following detailed description of the preferred embodiments with reference to the accompanying drawings, of which:

FIG. 5(*b*) is a chart showing the radiation pattern on the X-Y plane of the first preferred embodiment operating at 960 MHz frequency band;

FIG. 5(*c*) is a chart showing the radiation pattern on the Z-X plane of the first preferred embodiment operating at 960 MHz frequency band;

FIG. 5(*d*) is a chart showing the radiation pattern on the Y-Z plane of the first preferred embodiment operating at 960 MHz frequency band;

FIG. 6(*b*) is a chart showing the radiation pattern on the X-Y plane of the first preferred embodiment operating at 1850 MHz frequency band;

FIG. 6(*c*) is a chart showing the radiation pattern on the Z-X plane of the first preferred embodiment operating at 1850 MHz frequency band;

FIG. 6(*d*) is a chart showing the radiation pattern on the Y-Z plane of the first preferred embodiment operating at 1850 MHz frequency band;

FIG. 7(*b*) is a chart showing the radiation pattern on the X-Y plane of the first preferred embodiment operating at 1990 MHz frequency band;

FIG. 7(*c*) is a chart showing the radiation pattern on the Z-X plane of the first preferred embodiment operating at 1990 MHz frequency band;

FIG. 7(*d*) is a chart showing the radiation pattern on the Y-Z plane of the first preferred embodiment operating at 1990 MHz frequency band.

DETAILED DESCRIPTION OF THE PREFERRED EMBODIMENTS

Figure 1:
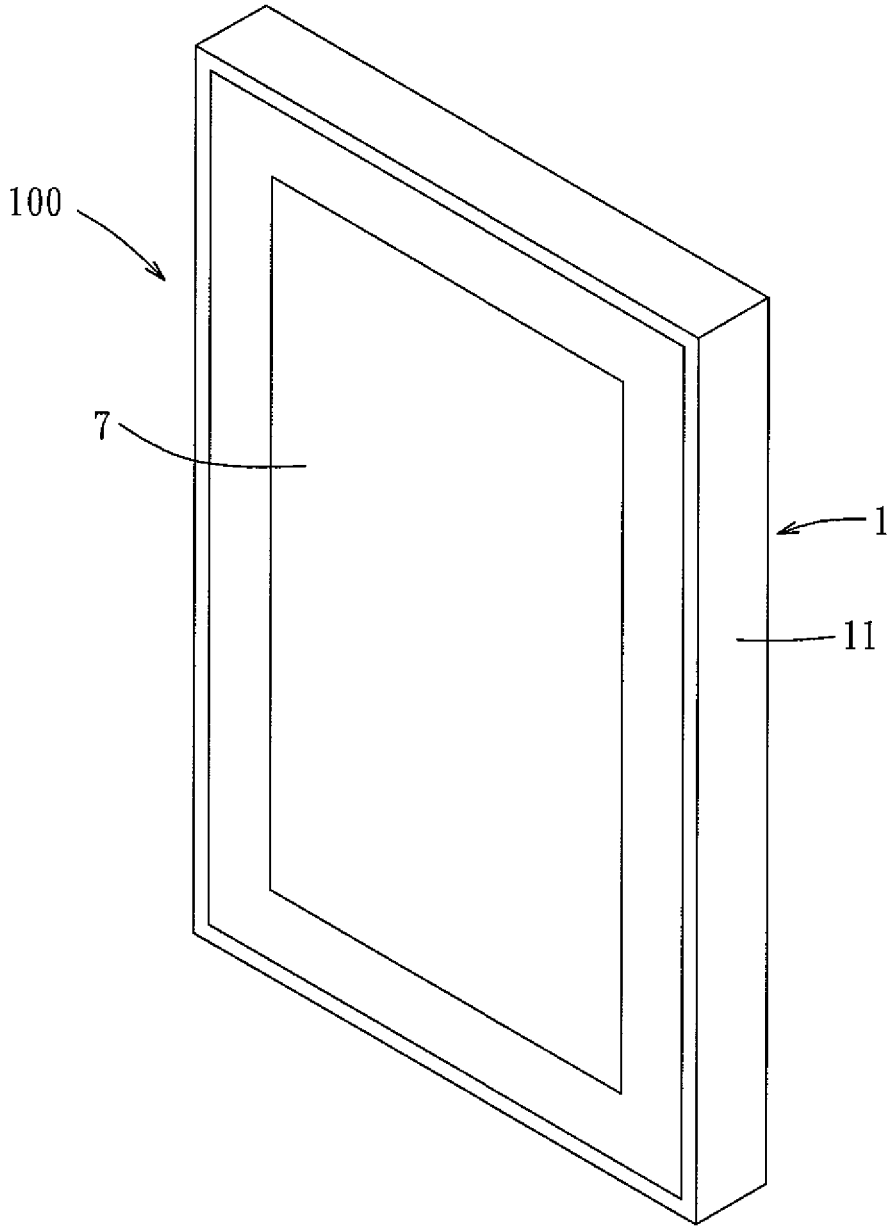
FIG. 1 is a perspective diagram of a first preferred embodiment of the portable electronic device of the present invention.

Before the present invention is described in greater detail, it should be noted that like elements are denoted by the same reference numerals throughout the disclosure.

Figure 2:
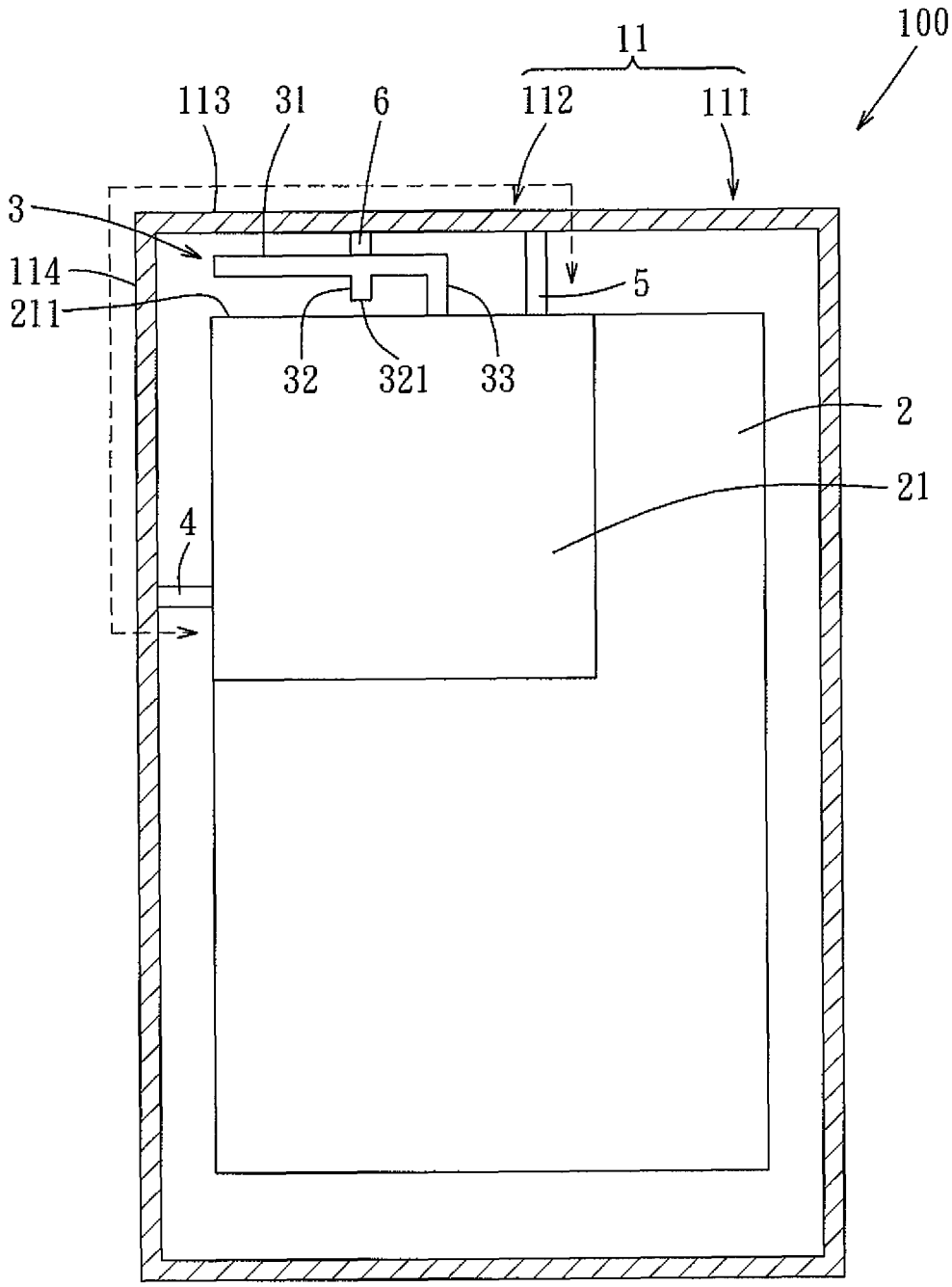
FIG. 2 is a schematic sectional view of the first preferred embodiment, showing internal structure thereof.

FIGS. 1 and 2 show a first preferred embodiment of the portable electronic device 100 of the present invention. The portable electronic device 100 includes a housing 1, a substrate 2, a radiation conductor 3, a first short circuit conductor 4, a second short circuit conductor 5 and a coupling conductor 6. A tablet computer having a touch panel 7 is used as an example to illustrate the portable electronic device 100. It should be noted that the portable electronic device 100 can be a mobile phone, a digital assistant or other electronic devices.

The housing 1 defines an accommodating space and includes a rectangular frame 11 made of a metallic material. The touch panel 7 is disposed in the accommodating space. The housing 1 defines an accommodating space and includes a frame 11 made of metallic material. The frame 11 has a body portion 111 and a radiation portion 112. In the first preferred embodiment, the radiation portion 112 is a continuous conductor with no breakpoints. The radiation portion 112 is L-shaped and includes a first section 113 and a second section 114 disposed perpendicular to the first section 113.

The substrate 2, being disposed in the accommodating space, is surrounded by the frame 11 and has a grounding portion 21. The grounding portion 21 has a lateral edge 211 disposed parallel to the first section 113 of the radiation portion 112.

The radiation conductor 3 is disposed in the accommodating space and is electrically coupled to the radiation portion 112. The radiation conductor 3 includes a radiation section 31 that is disposed spacedly and in parallel to the lateral edge 211 of the grounding portion 21, a feed-in section 32 that extends from the radiation section 31 towards the lateral edge 211 of the grounding portion 21, and a grounding section 33 that extends from a junction of the radiation section 31 and the feed-in section 32 to form an L-shape. One end of the grounding section 33 furthest away from the radiation section 31 is electrically coupled to the grounding portion 21. The radiation conductor 3 includes a feed-in point 321. In this embodiment, one end of the feed-in section 32 that is distal from the junction of the radiation section 31 and the feed-in section 32 and that is proximate to the lateral edge 211 serves as the feed-in point 321. The radiation conductor 3 is a planar inverted F antenna (PIFA) having a resonant length of one quarter wavelength.

The coupling conductor 6 connected between the radiation portion 112 of the frame 11 and the junction of the radiation section 31 and the feed-in section 32 so that the radiation conductor 3 is electrically coupled to the radiation portion 112.

The first short circuit conductor 4 is electrically coupled between an end of the second section 114 of the radiation portion 112 distal from the first section 113 and the grounding portion 21 such that the second section 114 is electrically coupled to the grounding portion 21. The second short circuit conductor 5 is electrically coupled between an end of the first section 113 of the radiation portion 112 distal from the second section 114 and the grounding portion 21 such that the first section 113 is electrically coupled to the grounding portion 21. In other words, the first and second short circuit conductors 4, 5 are electrically coupled to the grounding portion 21 respectively at opposite ends of the radiation portion 112. The first section 113 of the radiation portion 112 is electrically coupled between the second short circuit conductor 5 and the second section 114. The second section 114 of the radiation portion 112 is electrically coupled between the first short circuit conductor 4 and the first section 113.

Signal waves received at the feed-in point 321 flow to the radiation portion 112 of the frame 11 via the coupling conductor 6, and then flow in the directions indicated by the dotted lines in FIG. 2 to the grounding portion 21 through the first and second short circuit conductors 4, 5 to form a loop antenna having a resonant length of one half wavelength.

In the first preferred embodiment, the radiation portion 112 resonates at a first frequency band, and the radiation conductor 3 resonates at a second frequency band higher in frequency than the first frequency band.

Figure 3:
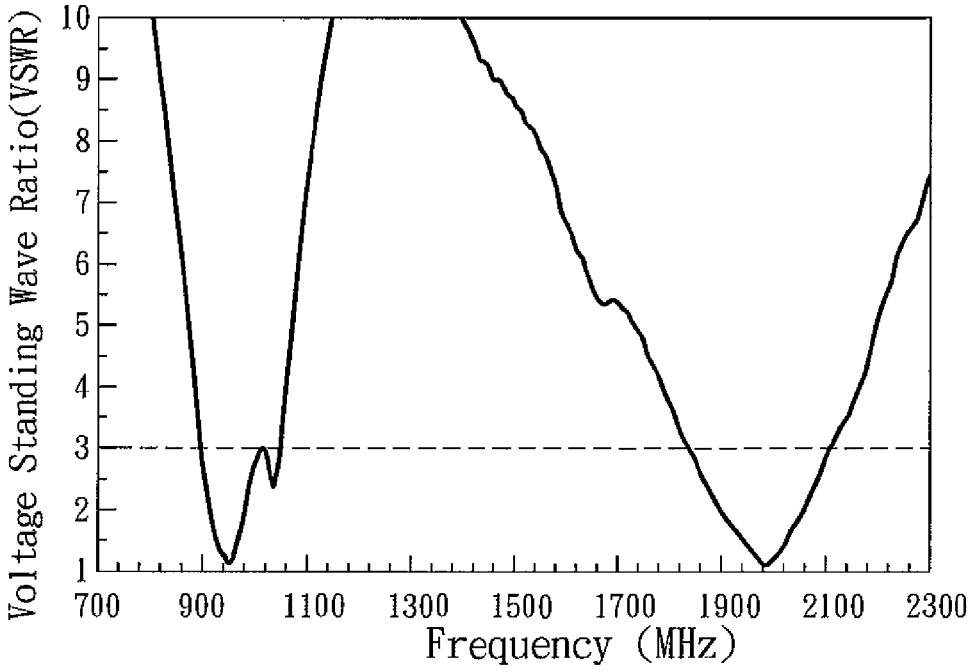
FIG. 3 is a diagram showing the voltage standing wave ratio (VSWR) of the first preferred embodiment.

FIG. 3 is a plot showing the voltage standing wave ratio (VSWR) of the first preferred embodiment measured by a vector network analyzer. As shown in the figure, the VSWR of the first frequency band (900-1050 MHz) and the second frequency band (1840-2100 MHz) are both less than 3:1.

Figure 4:
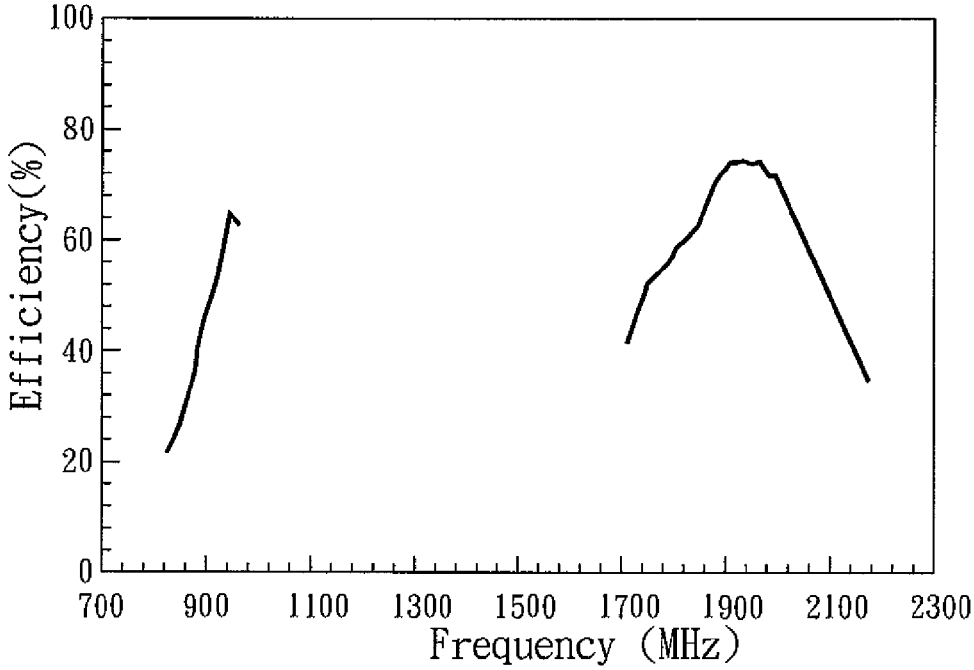
FIG. 4 is a diagram showing the efficiency of the first preferred embodiment.
Figure 5A:
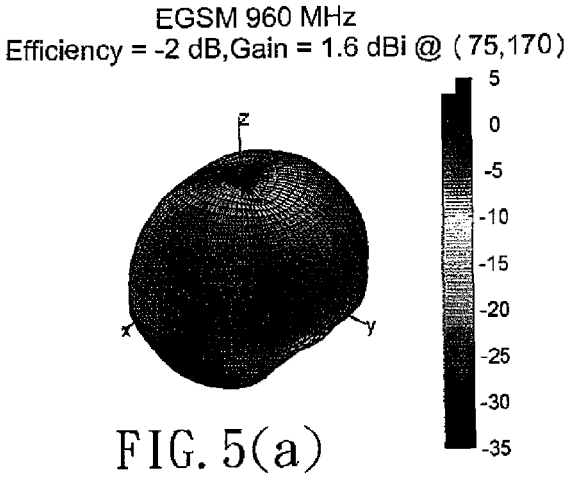
FIG. 5(*a*) is a three-dimensional chart showing the radiation pattern of the first preferred embodiment operating at 960 MHz frequency band.
Figure 5B:
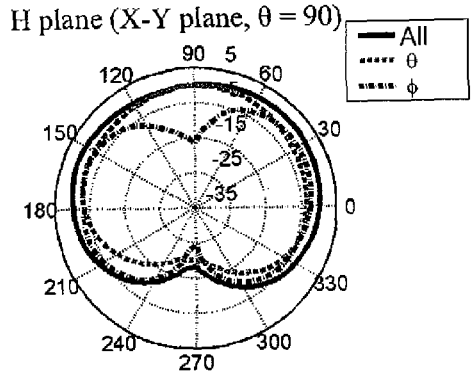
Figure 5C:
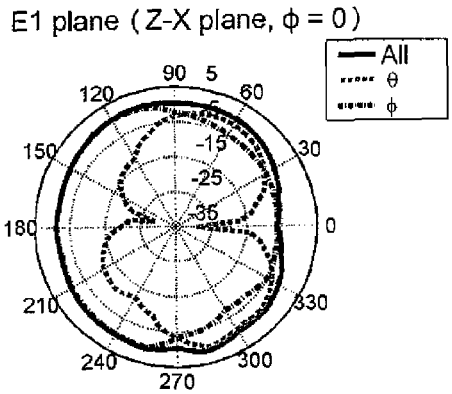
Figure 5D:
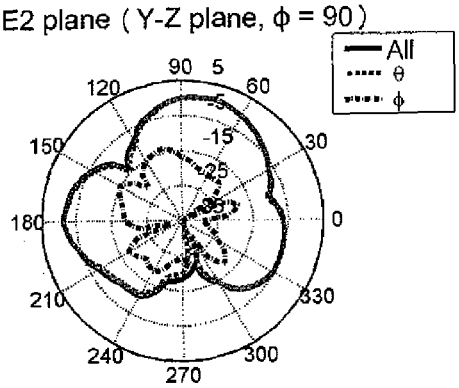
Figure 6A:
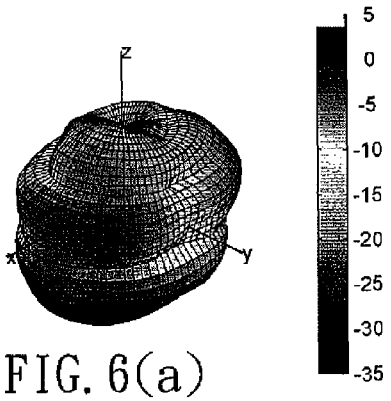
FIG. 6(*a*) is a three-dimensional chart showing the radiation pattern of the first preferred embodiment operating at 1850 MHz frequency band.
Figure 6B:
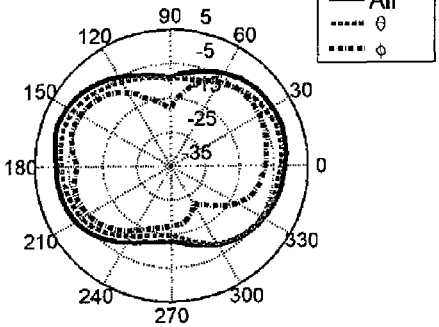
Figure 6C:
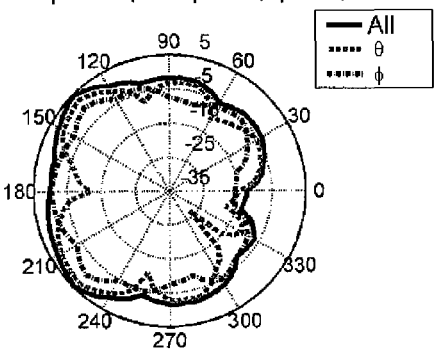
Figure 6D:
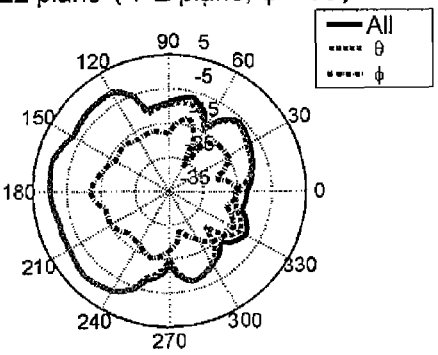
Figure 7A:
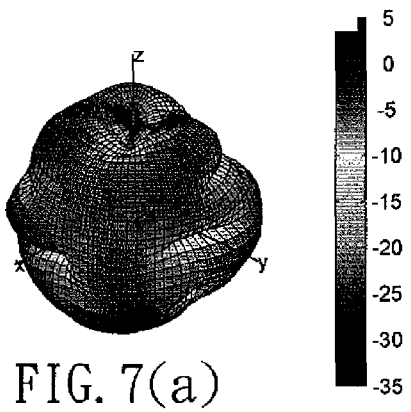
FIG. 7(*a*) is a three-dimensional chart showing the radiation pattern of the first preferred embodiment operating at 1990 MHz frequency band.
Figure 7B:
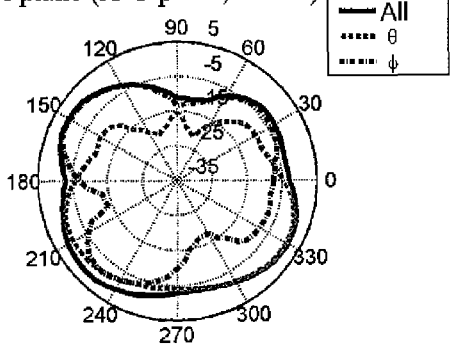
Figure 7C:
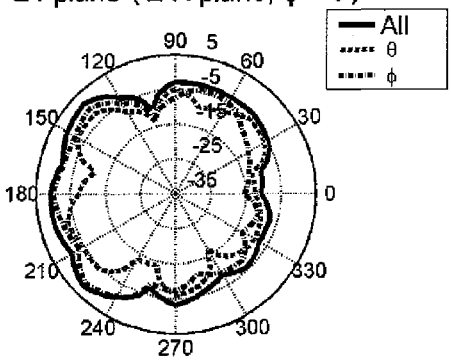
Figure 7D:
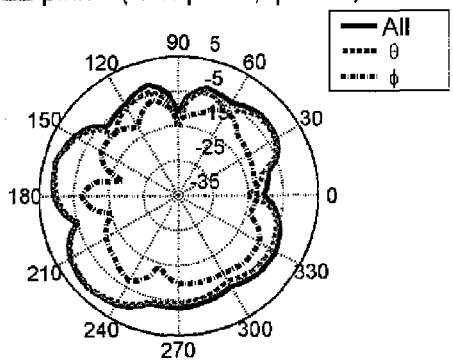

FIG. 4 is a plot showing antenna efficiency of the first preferred embodiment measured in an anechoic chamber. FIGS. 5(*a*) to 7(*d*) are charts showing radiation pattern of the first preferred embodiment respectively at 960 MHz, 1850 MHz and 1990 MHz frequency bands. It is evident that the first preferred embodiment has great omnidirectional performance in these frequency bands.

It is worth mentioning that the resonant modes triggered by the two antenna structures (PIFA and loop antenna) of the first preferred embodiment have low mutual influence. The triggered resonant mode of the loop antenna can be adjusted by adjusting the position of the radiation portion 112, which does not affect the triggered resonant mode of the PIFA.

Figure 8:
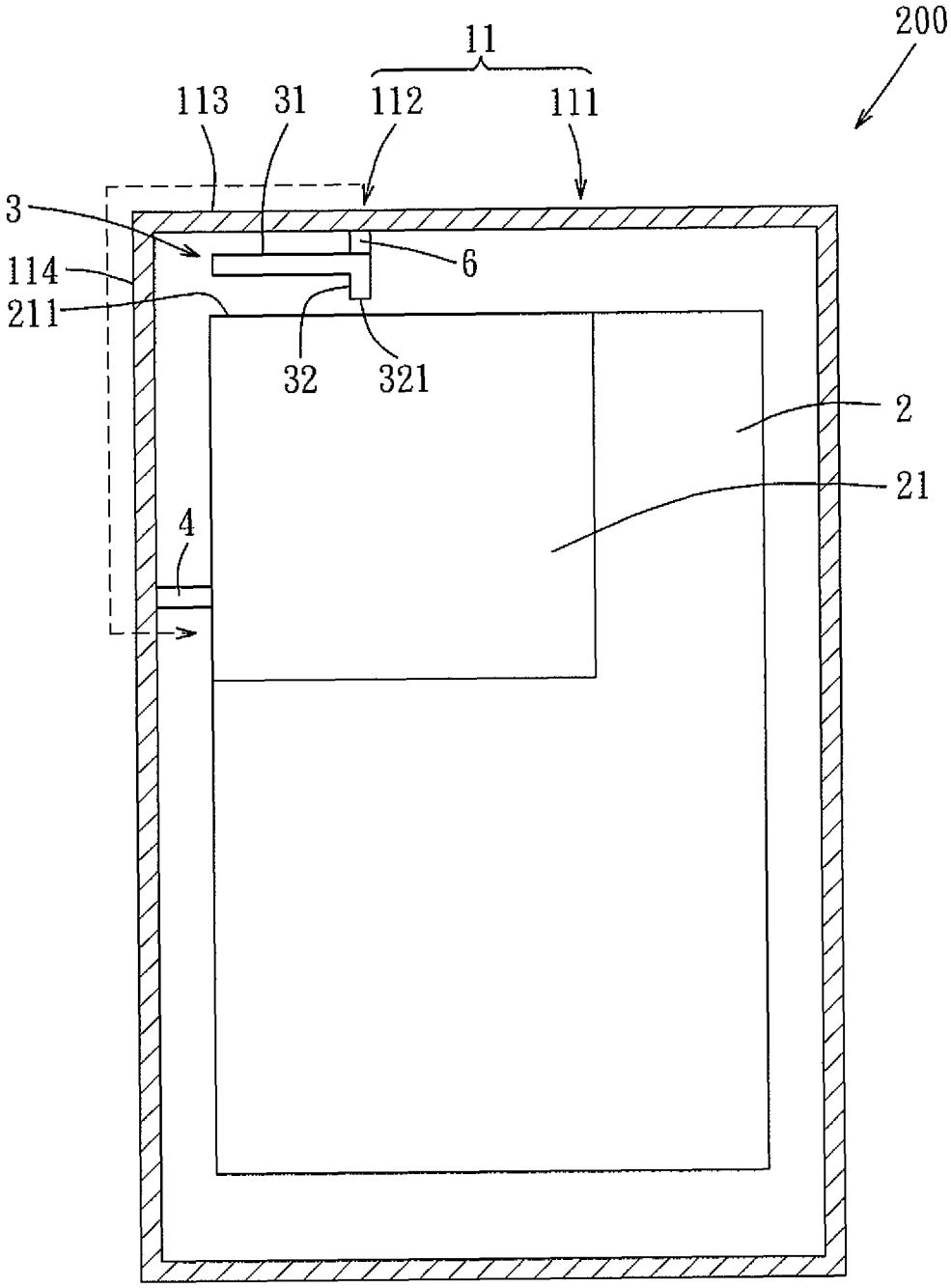
FIG. 8 is a schematic sectional view of a second preferred embodiment of the portable electronic device of the present invention.

FIG. 8 shows a second preferred embodiment of the portable electronic device 200 of the present invention. The portable electronic device 200 is similar to the first preferred embodiment with the differences to be described in the following. In the second preferred embodiment, the radiation conductor 3 only includes the radiation section 31 and the feed-in section 32. In other words, the radiation conductor 3 is a monopole-type antenna having a resonant length of one quarter wavelength. The frame 11 is also only electrically coupled to the grounding portion 21 of the substrate 2 via the first short circuit conductor 4.

From the above, the portable electronic devices 100, 200 have the set up of the first short circuit conductor 4, optionally the second short circuit conductor 5 and the coupling conductor 6. The first short circuit conductor 4, and the radiation portion 112 of the frame 1 form a loop antenna, effectively solving the problem of shielding of the radiation conductor 3 by the metallic frame 11. Also, incorporating PIFA (or monopole-type antenna) and loop antenna without having to increase the area allows the electronic devices 100, 200 to operate at different frequency bands.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A portable electronic device comprising:

a housing defining an accommodating space and including a frame that has a body portion and a radiation portion;

a substrate disposed in said accommodating space, surrounded by said frame, and having a grounding portion;

a radiation conductor disposed in said accommodating space, electrically coupled to said radiation portion, and including a feed-in point; and a first short circuit conductor electrically coupled between one end of said radiation portion and said grounding portion.

2. The portable electronic device as claimed in claim 1, further comprising a second short circuit conductor electrically coupled between the other end of said radiation portion and said grounding portion.

3. The portable electronic device as claimed in claim 2, wherein said radiation portion is a continuous conductor with no breakpoints.

4. The portable electronic device as claimed in claim 3, wherein said grounding portion has a lateral edge, said radiation conductor including a radiation section that is disposed spacedly and in parallel to said lateral edge, and a feed-in section that extends from said radiation section towards said lateral edge, one end of said feed-in section that is distal from a junction of said radiation section and said feed-in section and that is proximate to said lateral edge serving as said feed-in point.

5. The portable electronic device as claimed in claim 4, wherein said radiation conductor further includes a grounding section extending from the junction of said radiation section and said feed-in section and electrically coupled to said grounding portion.

6. The portable electronic device as claimed in claim 5, further comprising a coupling conductor connected between said radiation portion of said frame and the junction of said radiation section of said radiation conductor so that said radiation conductor is electrically coupled to said radiation portion.

7. The portable electronic device as claimed in claim 6, wherein said radiation portion has a first section and a second section, said first section being parallel to said lateral edge of said grounding portion and being electrically coupled at one end to said second short circuit conductor, said second section being perpendicular to said first section and being electrically coupled between said first short circuit conductor and the other end of said first section.

8. The portable electronic device as claimed in claim 2, wherein said radiation conductor is a monopole antenna spaced apart from said grounding portion.

9. The portable electronic device as claimed in claim 2, wherein said radiation conductor is a planar inverted F antenna.

10. The portable electronic device as claimed in claim 2, wherein said radiation portion resonates at a first frequency, and said radiation conductor resonates at a second frequency.

11. The portable electronic device as claimed in claim 10, wherein a resonant length of said radiation portion is substantially one half of a wavelength corresponding to the first frequency.

12. The portable electronic device as claimed in claim 10, wherein the resonant length of said radiation conductor is substantially one quarter of a wavelength corresponding to the second frequency.

* * * * *